US005466162A

United States Patent [19]

Schroepfer et al.

[11] Patent Number: 5,466,162

[45] Date of Patent: Nov. 14, 1995

[54] REMOVABLE HIGH DENSITY CONNECTOR

[75] Inventors: Richard C. Schroepfer, Thompsontown; Tracy L. Smith, Harrisburg, both of Pa.

[73] Assignee: The Whitaker Corporation, Wilmington, Del.

[21] Appl. No.: 129,826

[22] Filed: Sep. 30, 1993

[51] Int. Cl.[6] ..... H01R 9/09

[52] U.S. Cl. ..... 439/79; 439/67; 439/493; 439/498

[58] Field of Search ..... 439/79, 67, 77, 439/498, 271, 493

[56] References Cited

U.S. PATENT DOCUMENTS

| | | | |
|---|---|---|---|
| 3,113,248 | 12/1963 | Friedman | 439/77 X |
| 3,573,704 | 4/1971 | Tarver . | |
| 3,878,341 | 4/1975 | Balde | 439/493 X |
| 3,985,413 | 10/1976 | Evans . | |
| 4,116,516 | 9/1978 | Griffin | 439/67 OR |
| 4,552,420 | 11/1985 | Eigenbrode . | |
| 4,659,155 | 4/1987 | Walkup et al. . | |
| 4,682,828 | 7/1987 | Piper et al. | 439/77 X |
| 4,861,272 | 8/1989 | Clark . | |
| 4,881,901 | 11/1989 | Mendenhall et al. | 439/65 |
| 4,902,236 | 2/1990 | Hasircoglu | 439/77 |
| 4,948,379 | 8/1990 | Evans | 439/498 X |
| 4,959,030 | 9/1990 | Tatebe et al. | 439/67 |
| 5,007,842 | 4/1991 | Deak et al. | 439/66 |
| 5,026,291 | 6/1991 | David | 439/67 |
| 5,154,618 | 10/1992 | Nikoloff et al. | 439/67 |
| 5,156,553 | 10/1992 | Katsumata et al. | 439/62 |
| 5,161,986 | 11/1992 | Gulbranson et al. | 439/92 |
| 5,167,511 | 12/1992 | Krajewski et al. | 439/61 |
| 5,186,632 | 2/1993 | Horton et al. | 439/67 |
| 5,194,010 | 3/1993 | Dambach et al. | 439/67 X |
| 5,199,881 | 4/1993 | Oshita et al. | 439/65 |
| 5,348,482 | 9/1994 | Rudy, Jr. et al. | 439/61 |

OTHER PUBLICATIONS

Southard, *Hard–speed Signal Pathways From Board To Board,* Sep. 15, 1981, pp. 7–8, p. 8 Fig. 18.

Rhoads & Sigmon, *Signal Transmission Considerations for a Connector in Digital Input/Output Applications,* 1987, pp. 8–10, p. 10 Fig. 12.

*Primary Examiner*—David L. Pirlot
*Assistant Examiner*—Daniel Wittels
*Attorney, Agent, or Firm*—Kevin D. McCarthy

[57] ABSTRACT

An electrical connector made of overlapping layers of flexible film 8 carrying conductive traces 9 for interconnecting pins 1 to connection pads 10 on a printed circuit board surface 2a. Cylindrical elastomeric bodies 11 having parallel spaced apart conductors 25 thereon connect the traces 9 to the pads 10. Pins 1 impinge a rigid backing plate 18 upon axial forces to the pins 1 which resists axial movement of the pins 1 relative to solder joints 19 between the pins 1 and the traces 9.

9 Claims, 6 Drawing Sheets

REMOVABLE HIGH DENSITY CONNECTOR

FIELD OF THE INVENTION

This invention relates to a high density edge connector for a printed circuit board, and more particularly to a removable surface mounted connector for interconnecting pins and connection pads on a printed circuit board surface.

BACKGROUND OF THE INVENTION

Increased semiconductor complexity and increased miniaturization in electronic products causes the available surface space on a printed circuit board to be at a premium. Complex circuitry requires greater numbers of signal traces while the allotted space within which those traces may occupy continues to shrink. Within the context of edge connection systems, the space along the length of a printed circuit board is also at a premium. This has led to the use of multiple rows of interconnects to a printed circuit board on closely spaced pads, for example 0.025 inch (0.635 mm) centers. As digital system operating frequencies increase, the acceptable variations in timing from one trace to another decrease. It is therefore increasingly important to minimize timing skew by minimizing the absolute trace length and the relative variations in trace length in a connector. U.S. Pat. No. 4,861,272 to Clark discloses an interconnection system for mating a multiple row connector to multiple rows of connection pads on a printed circuit board while maintaining substantially similar connector trace lengths and trace impedances.

The greater the trace densities, the greater the detrimental effects of capacitive coupling. The capacitive coupling problem is addressed in the Clark patent by minimizing the effect of high trace densities by decoupling adjacent parallel conductive trace segments. The connector interface discussed by the Clark patent effects the interconnection to multiple rows of connection pads on the surface of a printed circuit board through use of a single layer of flexible film containing coplanar conductive traces. The pad spacing therefore remains constrained by the maximum allowable trace density in a single layer of flexible film.

Closely spaced pads require an accurate and reliable connection method. Soldering produces both a high integrity electrical connection and a mechanical connection that serves to secure the connector to the printed circuit board. It is, however, increasingly difficult when soldering pads on closely spaced centers to avoid bridging (shorting two adjacent pads) and nonconnection(open circuit between the connector and any single pad). When proper connection has been made, soldering is permanent in that removal of the soldered connector to replace, repair, or retrofit a part is labor intensive, costly, and can damage the printed circuit board and the circuitry thereon.

As connectors are miniaturized and achieve higher densities, the space within which a solder joint can be made shrinks. When a rigid solder joint exists between two parts that are moveable in opposite directions, the integrity of the solder joint is threatened. The smaller the joint, the less force it can withstand. In the context of a connector with a nonzero insertion force, it is desirable to provide some form of strain relief to assure the integrity of the solder joints over repeated matings.

SUMMARY OF THE INVENTION

It is an object of the present invention to provide a printed circuit board edge connector that makes electrical interconnection between pins and connection pads forming multiple rows on a printed circuit board surface.

It is another object of the present invention to provide an electrical connector that minimizes conductive trace lengths and trace densities.

It is another object of the present invention to provide an electrical connector that minimizes variations in pin to pad trace length and trace impedance.

It is another object of the present invention to provide an edge connector for a printed circuit board having a removable surface mount connection that may be cost effectively replaced and retrofitted.

It is another object of the present invention to provide a removable surface mount connector that is easily positioned over surface connection pads prior to securing the connector onto a printed circuit board.

It is another object of the present invention to provide a connector that maintains the integrity of connections between pins and conductive traces carried within flexible film layers through axial forces such as repeated matings of the pins with a complementary socket.

In view of these objectives and others, the present invention provides an electrical connector having pins passing through overlapping layers of flexible film. The layers of flexible film are insulated from each other and carry electrically conductive traces. Respective pins electrically connect to the conductive traces in respective layers of flexible film. Each layer has a different and sufficient length to permit the conductive traces in each layer to make individual contact with a printed circuit board surface.

The present invention also provides a removable surface mounted edge connector. At least one cylindrical elastomeric body having parallel spaced apart conductors thereon simultaneously engages conductive traces on a flexible film layer and connection pads on a printed circuit board surface. A housing with projecting latches aligns the cylindrical elastomeric circuit with the traces and the pads and receives a compression member that causes the conductors on the elastomeric body to engage the pads. Apertures in a retaining member receive the latches on the housing. Bolts removably secures the housing, the elastomeric bodies, and the compression member onto a printed circuit board. Among other benefits, a removably securable connector can be replaced, repaired, or retrofitted without damage to the printed circuit board.

The present invention also provides a rigid backing plate that furnishes strain relief to solder joints between the pins and conductive traces upon axial forces to the pins such as repeated matings of the pins with a complementary socket. The pins impinge the backing plate which resists movement of the pins relative to the conductive traces.

DESCRIPTION OF THE DRAWINGS

An embodiment of the invention will now be described, by way of example, with reference to the accompanying drawings, according to which.

DETAILED DESCRIPTION OF THE PREFERRED EMBODIMENT

Figure 1:
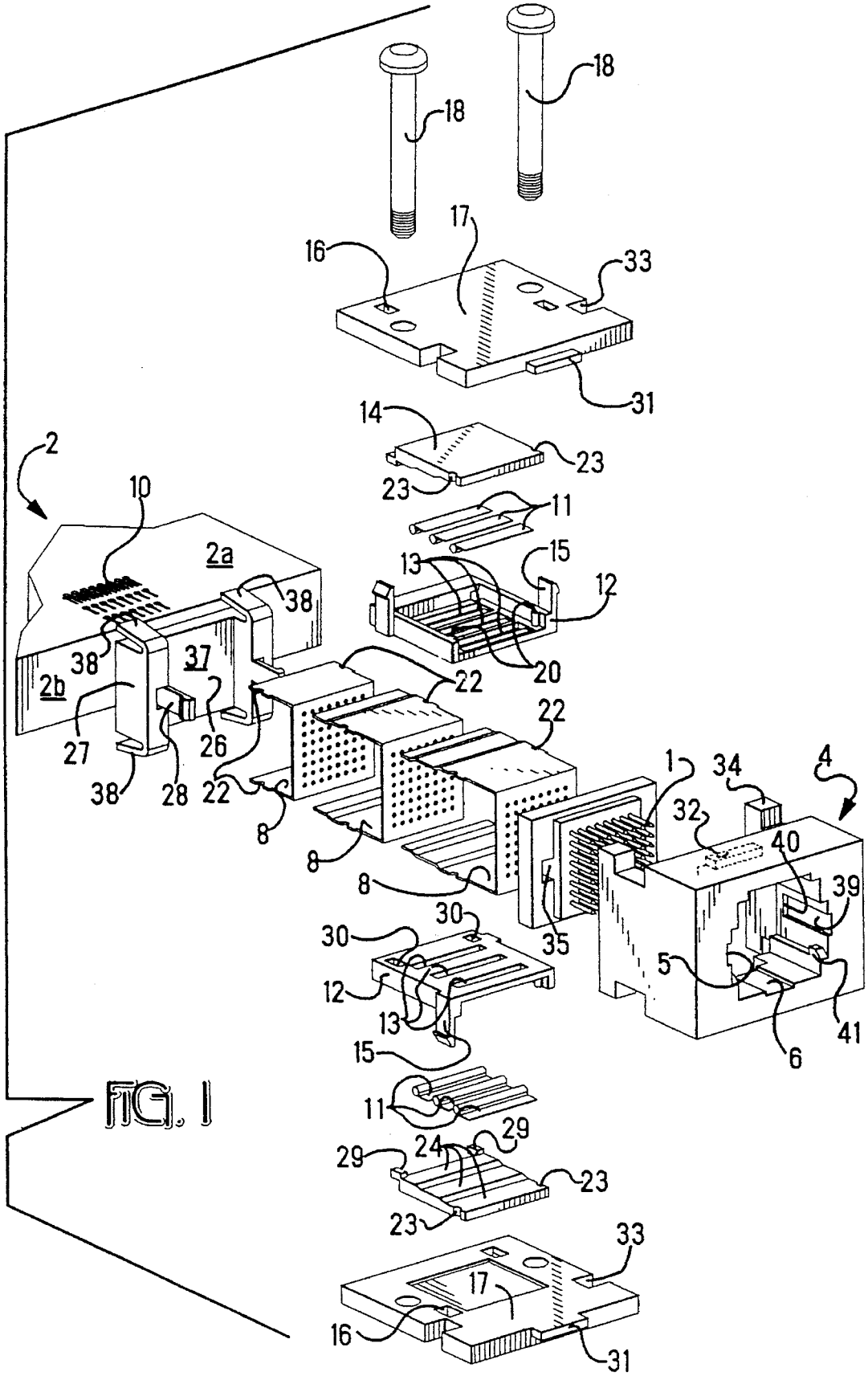
FIG. 1 is a perspective view of the connector in relationship to a printed circuit board with parts shown separated from each other.
Figure 2:
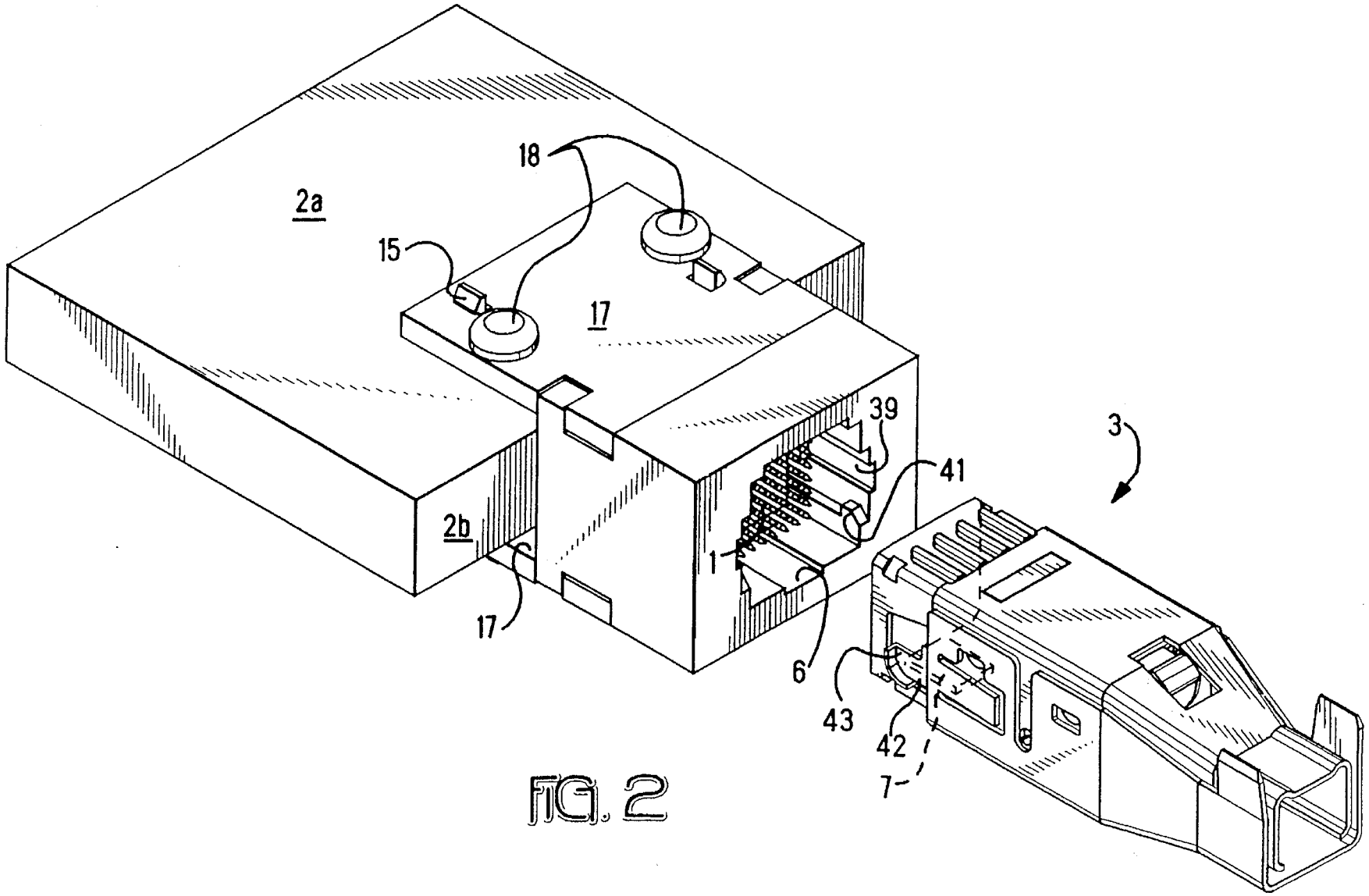
FIG. 2 is a view of the assembled connector mounted on a printed circuit board and its complementary socket.
Figure 3:
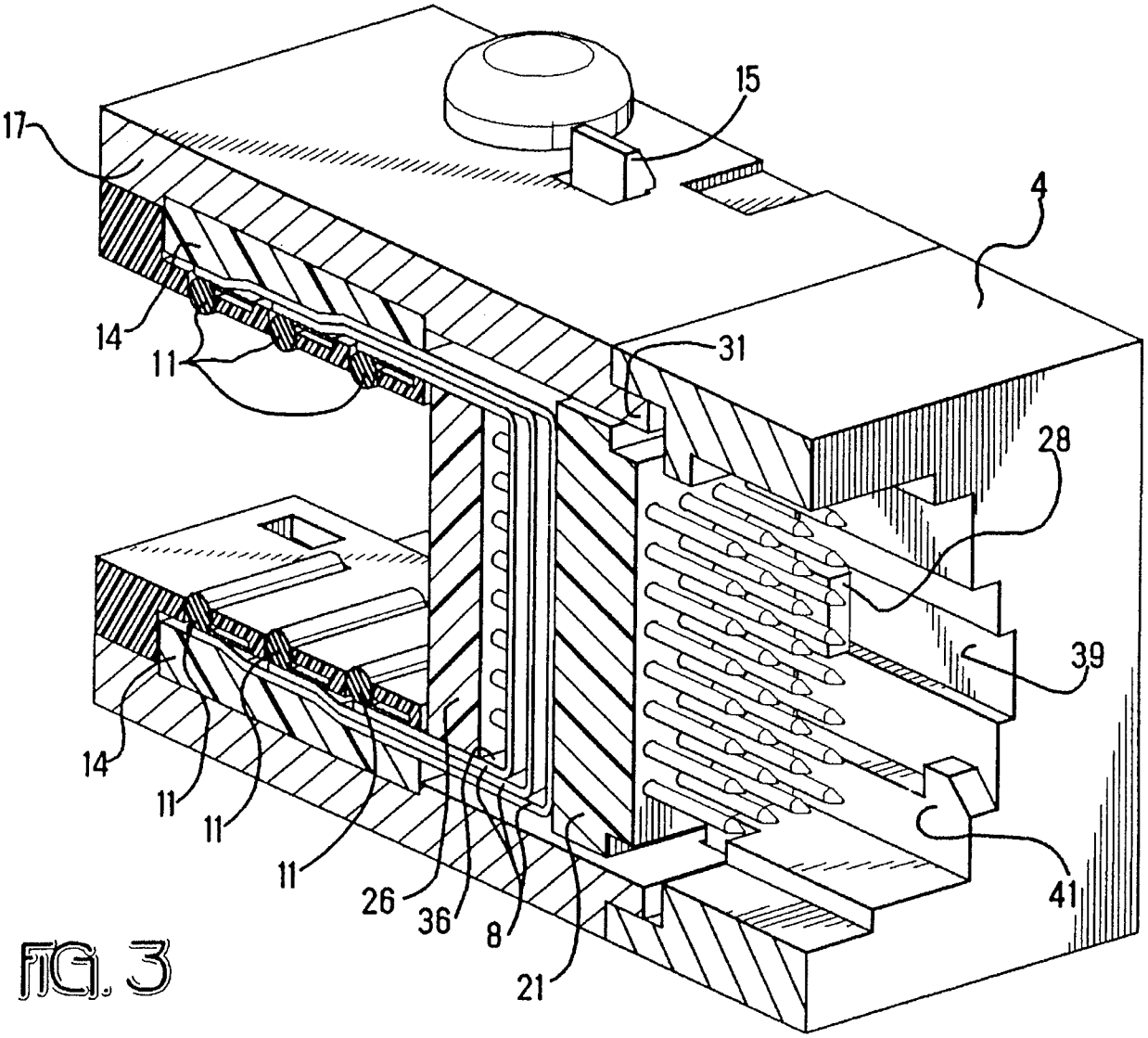
FIG. 3 is a three dimensional cross sectional view of the assembled connector.

Referring to FIG. 1, an electrical edge connector comprises pins 1 for mating to a complementary socket 3. A protective shroud 4 encircles the pins 1 and serves to define a mating profile 5 and to protect the pins 1 from lateral forces that might otherwise cause damage. The mating profile 5 of the protective shroud 4 has a groove 6. The complementary socket 3 has a corresponding ridge 7 that fits within the groove 6 to prevent improper mating of the pins 1 and socket 3. Referring to FIG. 2, the socket 3 engages the shroud 4 by two pivotably secured arms 42 spring loaded in the closed position as described in patent application Ser. No. 07/831,254 filed Jan. 24, 1992 by George Richard Defibaugh, et al. Hooks 43 at a pivoting end of the arms 42 engage shoulders 41 on the shroud 4 preventing disconnection of the shroud 4 with the socket 3.

Figure 7:
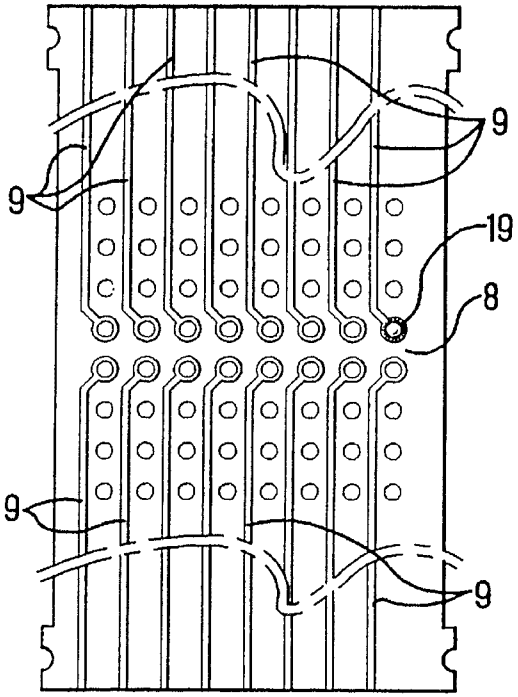
FIGS. 5 through 7 is a diagram of conductive traces contained in each of the flexible film layers with the overlapping alignment relationship depicted in a side by side view.
Figure 6:
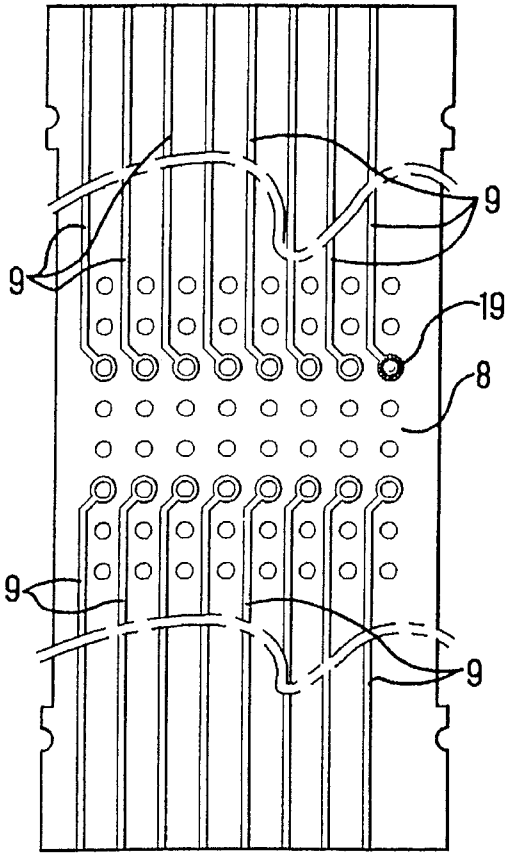
Figure 5:
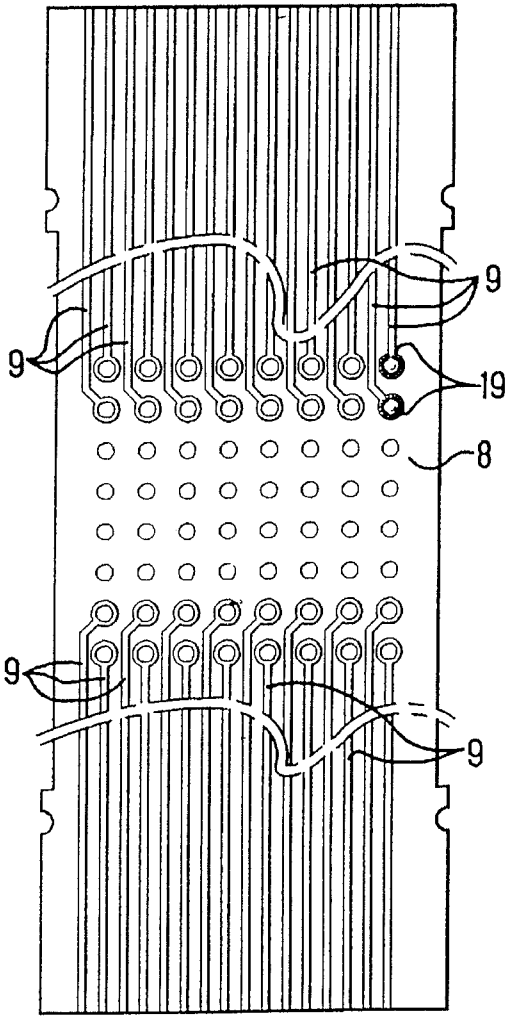
Figure 8:
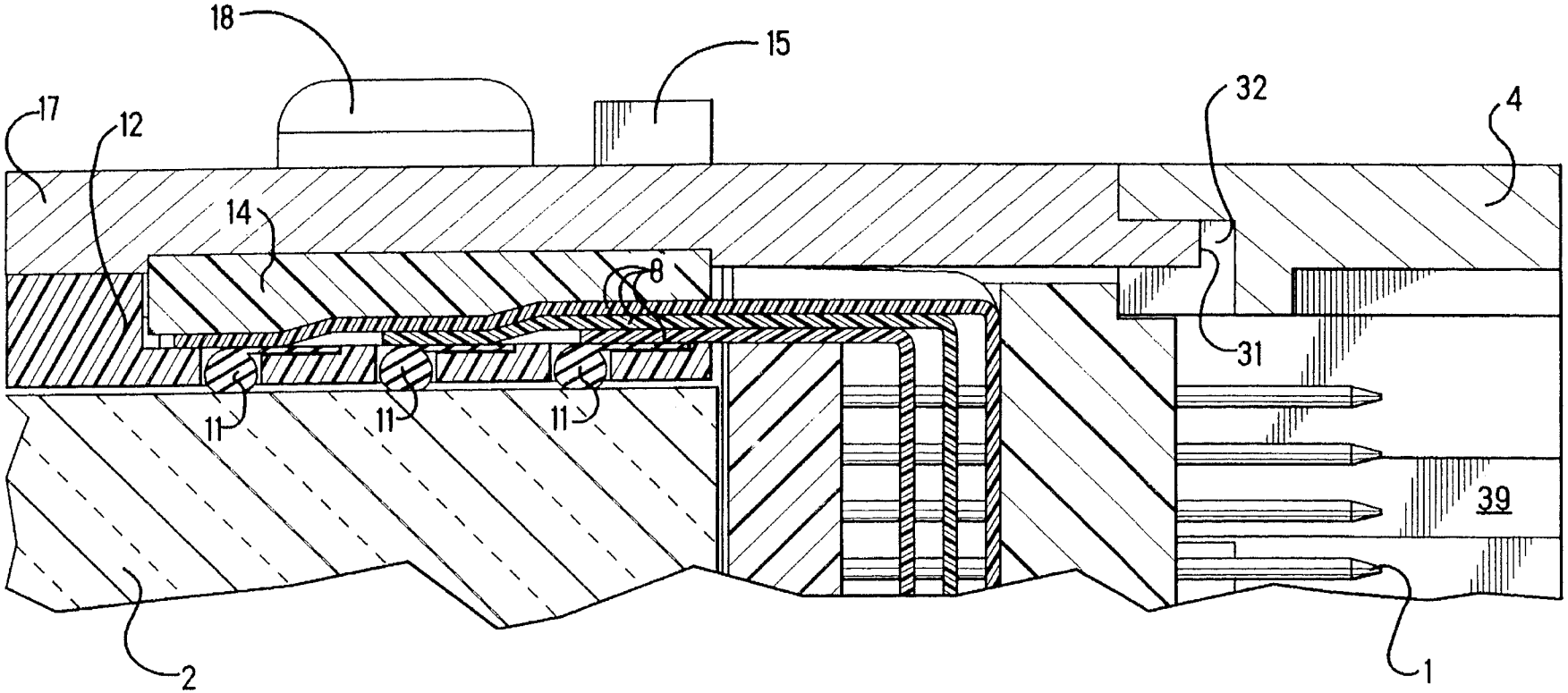
FIG. 8 is a cross sectional view of a portion of the assembled connector including a housing, cylindrical elastomeric circuits, and a compression meter as it contacts the surface of a printed circuit board

Overlapping layers 8 of flexible film, insulated from each other, carry conductive traces 9 and are shown in FIGS. 5 through 7. The pins 1 pass through all of the layers 8. Pins 1 are selectively soldered to the conductive traces 9 in respective flexible film layers 8 creating solder joints 19 between corresponding pins 1 and conductive traces 9. Each flexible film layer 8 has a different and sufficient length to bring the conductive traces 9 carried therein into individual contact with connection pads 10 that form rows on a printed circuit board surface 2*a*.

Pads 10 forming a row on the printed circuit board surface 2*a* connect to pins 1 forming a row through conductive traces 9 carried within a flexible film layer 8. Traces 9 carried within a layer 8 closest to the shroud 4 extend between pads 10 forming a row on the printed circuit board surface 2*a* farthest from a printed circuit board connector edge 2*b* and pins 1 forming a row closest to the pads 10. Traces 9 in a subsequent layer 8 extend between the pads 10 forming a row adjacent to the pads 10 farthest from the connector edge 2*b* and pins 1 forming a row adjacent to the pins 1 forming a row closest to the pads 10. Traces 9 in a layer 8 farthest from the shroud 4 extend between pads 10 forming a row closest to the connector edge 2*b* and pins 1 forming a row farthest from the pads 10. Referring to FIG. 5 through 7, the resulting geometry of the conductive traces 9 is such that trace lengths in each of the flexible film layers 8 are substantially similar.

Figure 4:
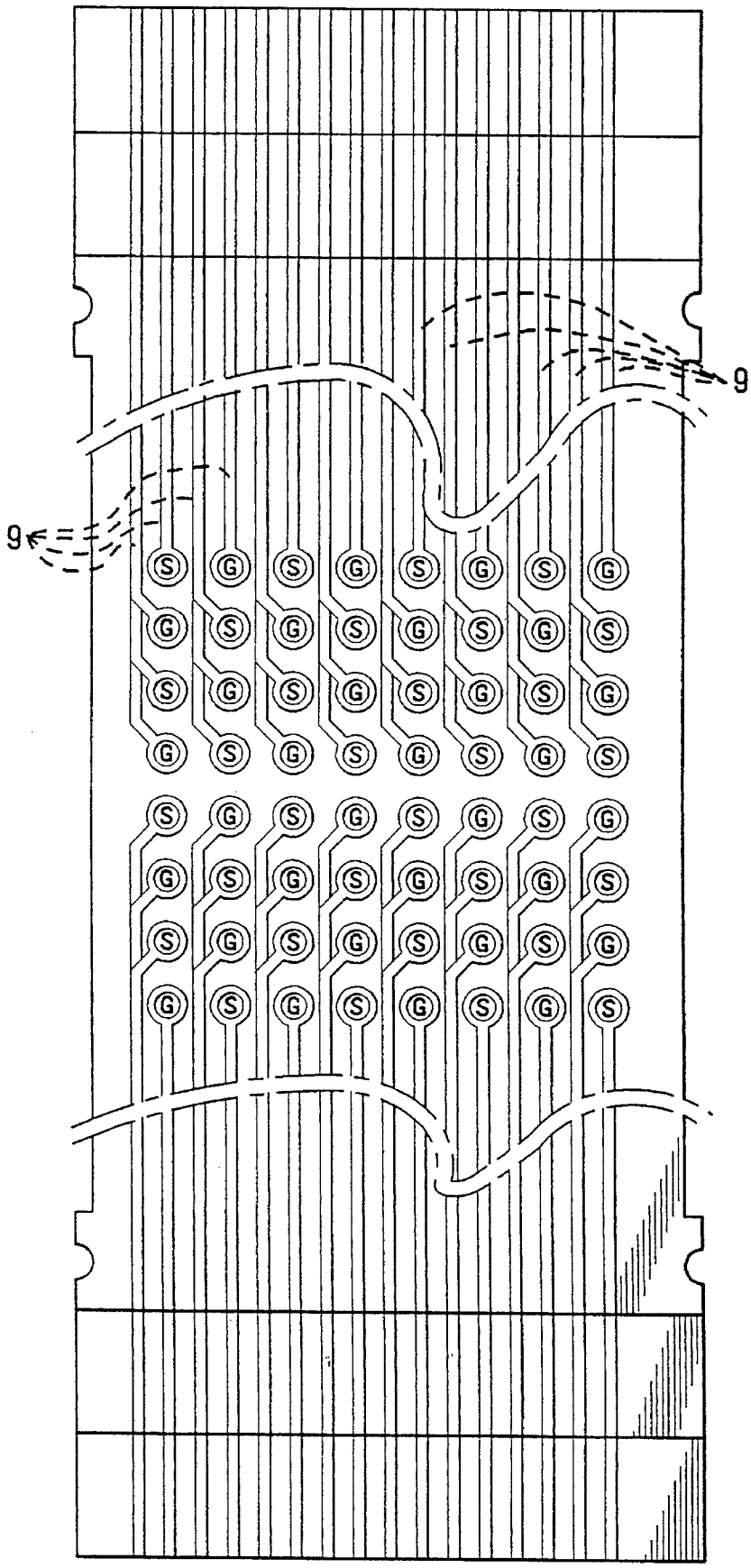
FIG. 4 is a diagram of signal and reference potential pin assignments in the pin array.

Referring to FIG. 4, pins 1 that carry signal potential are adjacent to pins 1 that carry reference potential. This results in minimal fanout from a multiple conductor cable (not shown) to the socket 3 and a close pairing of signal and its associated reference potential.

Referring to FIG. 1, a solderless and removable surface mount system interconnects the conductive traces 9 carried within the flexible film layers 8 and the connection pads 10. Cylindrical elastomeric bodies 11 with parallel spaced apart conductors 25 thereon electrically connect the conductive traces 9 to the pads 10. The elastomeric bodies 11 have properties such as the cylindrical elastomeric circuit disclosed in U.S. Pat. No. 3,985,413 to Evans. The Evans patent discloses a miniaturized electrical connector for reliably connecting two substrates containing multiple traces by using parallel spaced apart conductors wrapped around an elastomeric body. The quantity of cylindrical elastomeric bodies 11 corresponds to the number of flexible film layers 8.

A housing 12 receives the cylindrical elastomeric bodies 11 between framed openings 13 and a compression member 14. Projections 20 on the housing 12 fit within recesses 22, 23 on the layers 8 and the compression member 14 respectively, to contain the elastomeric bodies 11 within an assembled connector and to align the bodies 11 with the traces 9. The compression member 14 has stages 24 of varying thickness. Referring to FIG. 6, the width of the framed openings 13 in the housing 12 are sufficiently large to accomodate radial expansion of the elastomeric bodies 11 as they are compressed by the compression member 14. The number of stages 24 of varying thickness on the compression member 14 corresponds to the number of cylindrical elastomeric bodies 11 the housing 12 receives. Each stage 24 of thickness of the compression member 14 varies according to the relative number of flexible film layers 8 the compression member 14 accomodates in a single stage. A stage that accomodates a greater number layers 8 is less thick than a stage that accomodates fewer layers 8. Juxtaposed stages 24 vary in degree by the thickness dimension of a single flexible film layer 8 so that the compression member 14 provides substantially uniform compression to each elastomeric body 11.

Referring to FIG. 1, the compression member 14 has tabs 29 that interlock with notches 30 in the housing and resist disassembly of the housing 12, the elastomeric bodies 11, and the compression member 14 The housing 12 has latches 15 projecting from its surface that mate with apertures 16 in a retaining member 17 and prevent disassembly of the housing 12, elastomeric bodies 11, compression member 14, and the retaining member 17. The retaining member 17 has a tab 31 and notches 33 that interlock with a corresponding notch 32 and tabs 34 on the protective shroud 4 that resist disassembly of the retaining member 17 and the protective shroud 4. The retaining member 17 receives bolts 18 to secure the retaining member 17 onto a printed circuit board 2. The retaining member 17 encloses the housing 12, the elastomeric bodies 11, and the compression member 14 between the printed circuit board 2 and the retaining member 17. Because the connector in this invention is secured through bolts 18 and is electrically connected to the pads 10 by frictional engagement of the conductors 25 on the elastomeric bodies 11, the connector can be removed and resecured without damage to a printed circuit board 2. Once removed, the connector can be easily repaired through replacement and reconnection with a similarly configured connector. Removability of an installed connector in conjunction with the use of conductive traces 9 carried within each flexible film layer 8 also affords the possibility of retrofitting existing connectors. Modifications to artwork for existing flexible film layers 8 will effect desired changes in connector design such as routing pattern, signal and reference potential designations, and connector impedances without requiring retooling of connector parts.

A rigid backing plate 26, located at the rear of the pins 1, has two sidewalls 27. Each sidewall has a latch 28 projecting therefrom. A pin plate 21 carrying the pins 1 has apertures 35 through which the latches 28 on the sidewalls 27 extend.

The pin plate 21 rests against the sidewalls 27 defining an open-ended passage 36. The flexible film layers 8 extend through the passage 36 and between the elastomeric bodies 11 and the compression member 14. The rear ends of the pins 1 pass through the flexible film layers 8 and into the passage 36. The pins 1 impinge the backing plate 26 at a rear wall 37 of the passage 36 upon mating of the pins 1 with the complementary socket 3. The backing plate 26 resists axial displacement of the pins 1 relative to the flexible film layers 8 to provide strain relief for the solder joints 19 between the traces 9 in the flexible film layers 8 and the pins 1.

Four plastic molded spring members 38 are on either end of the sidewalls 27. The retaining members 17 rest against the spring members 28. The cantilevered spring members 28 bias the retaining members 17 away from each other when the connector is unbolted. The retaining members 17 deflect the spring members 17 toward each other when the connector is bolted to the printed circuit board 2.

The pin plate 21 carrying the pins 1 nests within the protective shroud 4. The latches 28 on the sidewalls 27 extend through the apertures 35 in the pin plate 21 and into channels 39 on the protective shroud 4. The latches 28 on the sidewalls 27 enter into the channel 39 and lock onto a shoulder 40 at an end of the channel 39 to prevent disassembly of the backing plate 26, layers 8, and pin plate 21 with the shroud 4.

I claim:

1. An electrical connector comprising:

overlapping layers of flexible film insulated from each other, each said layer carrying electrically conductive traces, and each said layer having differing and sufficient length to make individual contact with connection pads on a printed circuit board surface, connector pins passing through said layers, selective electrical connections between said pins and said traces, cylindrical elastometric bodies having parallel spaced apart conductors thereon, and a quality of said bodies corresponding to the quantity of said layers wherein, said conductors simultaneously engage said traces and said pads.

2. An electrical connector as recited in claim 1 wherein said selective electrical connections are soldered joints and the connector further comprising a rigid backing plate impinging said pins and resisting axial movement of said pins relative to said joints between said pins and said traces.

3. An electrical connector as recited in claim 1 and further comprising:

(a) a housing having framed openings to receive said bodies and to align said bodies with said traces and said pads, (b) latches projecting from a surface of said housing, (c) a compression member fittably mounted within said housing causing said bodies to engage said pads, (d) a retaining member mating with said latches and removably securing said housing, said bodies, and said compression member to the printed circuit board.

4. An electrical connector as recited in claim 3 wherein said selective electrical connections are soldered joints and the connector further comprising a rigid backing plate impinging said pins and resisting axial movement of said pins relative to said joints between said pins and said traces.

5. An electrical connector as recited in claim 1 wherein, traces in a layer extend between pads in a row farthest from a connector edge of the printed circuit board and pins forming a row closest to said pads and traces in subsequent layers extend between pads forming subsequent rows and pins forming subsequent rows.

6. An electrical connector as recited in claim 1 wherein, pins carrying signal potential are adjacent to pins carrying reference potential.

7. A removable surface mounted edge connector comprising:

(a) at least one layer of flexible film, (b) conductive traces carried within each said layer, (c) connection pads on a printed circuit board surface, (d) each said layer having a differing and sufficient length for said traces to make individual contact with said pads, (e) at least one cylindrical elastomeric body having parallel spaced apart conductors thereon wherein, said conductors simultaneously engage said traces and said pads, (f) a housing having at least one framed opening to receive said bodies and to align said bodies with said traces and said pads, (g) latches projecting from a surface of said housing, (h) a compression member fittably mounted within said housing compressing said bodies and causing said conductors to engage said pads, and (i) at least one retaining member mating with said latches and removably securing said housing, said bodies, and said compression member to a printed circuit board.

8. An electrical connector as recited in claim 7 and further comprising:

(a) first and second retaining members removably secured to the printed circuit board with bolts extending through said retaining members, (b) a rigid backing plate with sidewalls at opposite ends, and (c) spring members on either side of each said sidewall that receive said retaining members and bias said retaining members away from each other.

9. An electrical connector as recited in claim 7 and further comprising:

(a) pins passing through said layers, (b) selectively soldered joints between said traces and pins in said pins, and (c) a rigid backing plate impinging said pins and resisting axial movement of said pins relative to said joints.

* * * * *